US005448781A

United States Patent [19]

Miller

[11] Patent Number: 5,448,781

[45] Date of Patent: Sep. 12, 1995

[54] COMBINATION TOILET SEAT

[76] Inventor: Harry R. Miller, P.O. Box 1862, Vernon, British Columbia, Canada, V1T 8C3

[21] Appl. No.: 169,014

[22] Filed: Dec. 20, 1993

[30] Foreign Application Priority Data

Jan. 10, 1993 [CA] Canada ..... 2107500

[51] Int. Cl.[6] ..... A47K 13/12; A47K 13/00

[52] U.S. Cl. ..... 4/235; 4/236; 4/240; 16/257; 16/259; 16/380

[58] Field of Search ..... 4/235, 236, 240; 16/257, 259, 380, DIG. 43, 225, 229, 254, 262, 263, 270

[56] References Cited

U.S. PATENT DOCUMENTS

| | | | |
|---|---|---|---|
| 305,357 | 1/1890 | Ritzer | D23/311 |
| 306,899 | 3/1890 | Miller | D23/296 |
| 548,367 | 10/1895 | High . | |
| 1,030,801 | 6/1912 | Berault | 16/380 |
| 1,196,427 | 8/1916 | Brandenburg . | |
| 1,520,301 | 12/1924 | Michel . | |
| 1,739,001 | 12/1929 | Justus . | |
| 1,990,869 | 2/1935 | Joyce . | |
| 2,047,480 | 7/1936 | Macdonald . | |
| 2,221,991 | 11/1940 | Myers et al. | 4/239 |
| 2,434,889 | 1/1948 | Sacia . | |
| 2,461,160 | 2/1949 | Joyce . | |
| 2,692,992 | 11/1954 | Thimmes et al. . | |
| 2,820,969 | 1/1958 | Wedge | 4/239 |
| 2,947,025 | 8/1960 | Czuduk, Jr. | 4/236 |
| 3,188,686 | 6/1965 | Occutt | 16/263 |
| 3,609,775 | 10/1971 | Leitek et al. | 4/235 |
| 3,852,943 | 12/1974 | Healy | 16/257 |
| 4,181,988 | 1/1980 | Skaggs . | |
| 4,516,279 | 5/1985 | Block | 4/235 |
| 4,680,816 | 7/1987 | Colombani | 4/236 |

FOREIGN PATENT DOCUMENTS

| | | | |
|---|---|---|---|
| 478405 | 2/1953 | Italy | 4/240 |
| 2069562 | 8/1981 | United Kingdom | 4/240 |

*Primary Examiner*—Henry J. Recla
*Assistant Examiner*—Gregory M. Vidovich
*Attorney, Agent, or Firm*—Philip Furgang

[57] ABSTRACT

A toilet seat assembly comprising a first seat, a second smaller seat supported by said first seat when in a lowered position thereof, a cover for the first and second seats, a hinge block and retractable hinge pins for hingedly connecting the first and second seats and the cover to the hinge block.

16 Claims, 3 Drawing Sheets

COMBINATION TOILET SEAT

FIELD OF THE INVENTION

The present invention relates to a toilet seat and cover and more particularly to a combination seat facilitating use by both infants and adults.

BACKGROUND OF THE INVENTION

Toilet seats which combine both an infant and an adult seat are well known in the art and reference is made in this regard to U.S. Pat. Nos. D. 306,899, D. 281,193, D. 305,357, 548,367, 904,053, 1,196,427, 1,236,902, 1,520,301, 1,616,020, 1,636,649, 1,739,001, 1,990,869, 2,047,480, 2,221,991, 2,434,889, 2,461,160, 2,692,992, 3,609,775 and 4,181,988, Australian Patent 110,261 and U.K. Patent No. 1,218,765, all of which disclose various approaches to this product.

For the most part however, commercial acceptance has eluded combination seats due to a number of factors including aesthetics, costs, inconvenience and poor cleanability. Another factor is that after the infant has grown, the purchaser must either live with the additional and no longer needed seat or dispose of the entire unit at considerable cost. Some prior units allow the infant seat to be removed when no longer needed, but visual evidence that the unit was once a combination seat usually remains, the evidence being in the form of gaps, unused recesses, bulk and weight.

SUMMARY OF THE INVENTION

It is therefore an object of the present invention to provide an improved combination seat that obviates and mitigates from the disadvantages of the prior art.

It is a further object of the present invention to provide a combination seat that is convenient to use, easily cleaned and readily converted to a conventional seat.

According to the present invention then, there is provided a toilet seat assembly comprising a first seat, a second smaller seat supported by the first seat when in a lowered position thereof, a cover for the first and second seats, a hinge block, and retractable pin means for hingedly connecting the first and second seats and the cover to the hinge block.

BRIEF DESCRIPTION OF THE DRAWINGS

Preferred embodiments of the present invention will now be described in greater detail and will be better understood when read in conjunction with the following drawings, in which.

DETAILED DESCRIPTION

Figure 1:
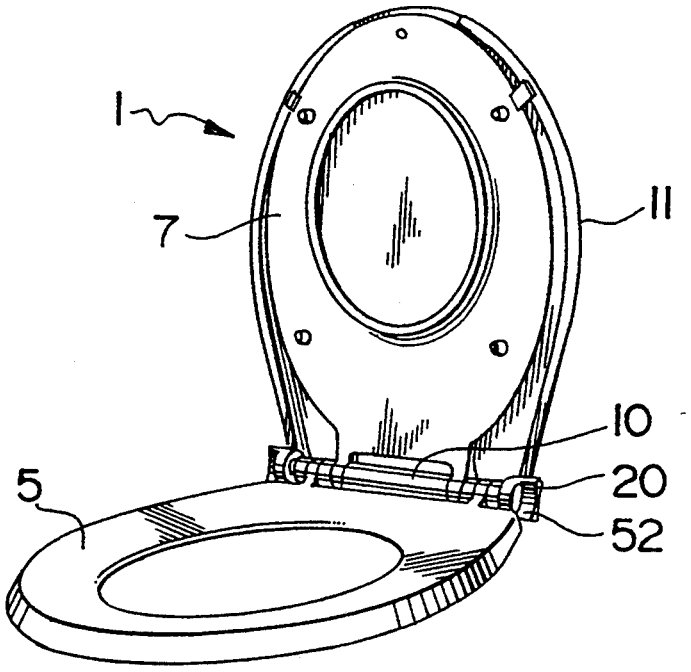
FIG. 1 is a perspective view of the present seat with the infant seat in a raised position.
Figure 2:
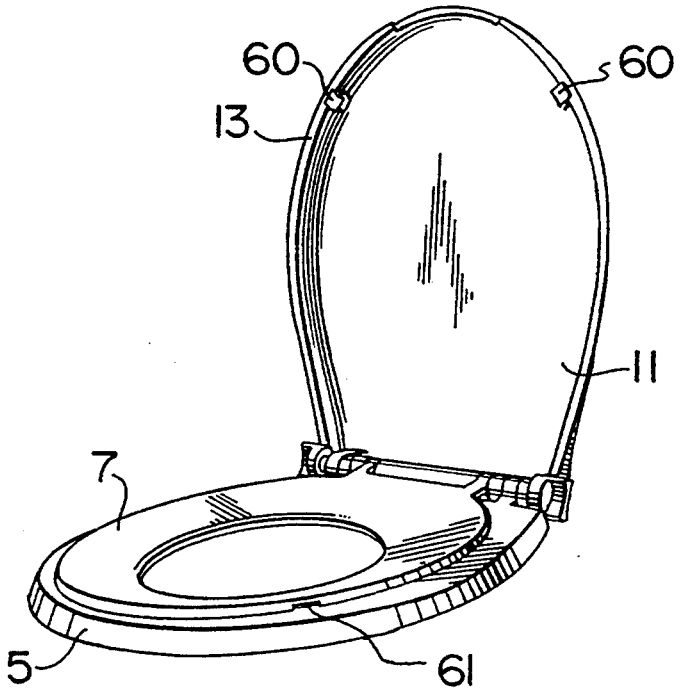
FIG. 2 is a perspective view of the present seat with the infant seat in a lowered position.
Figure 3:
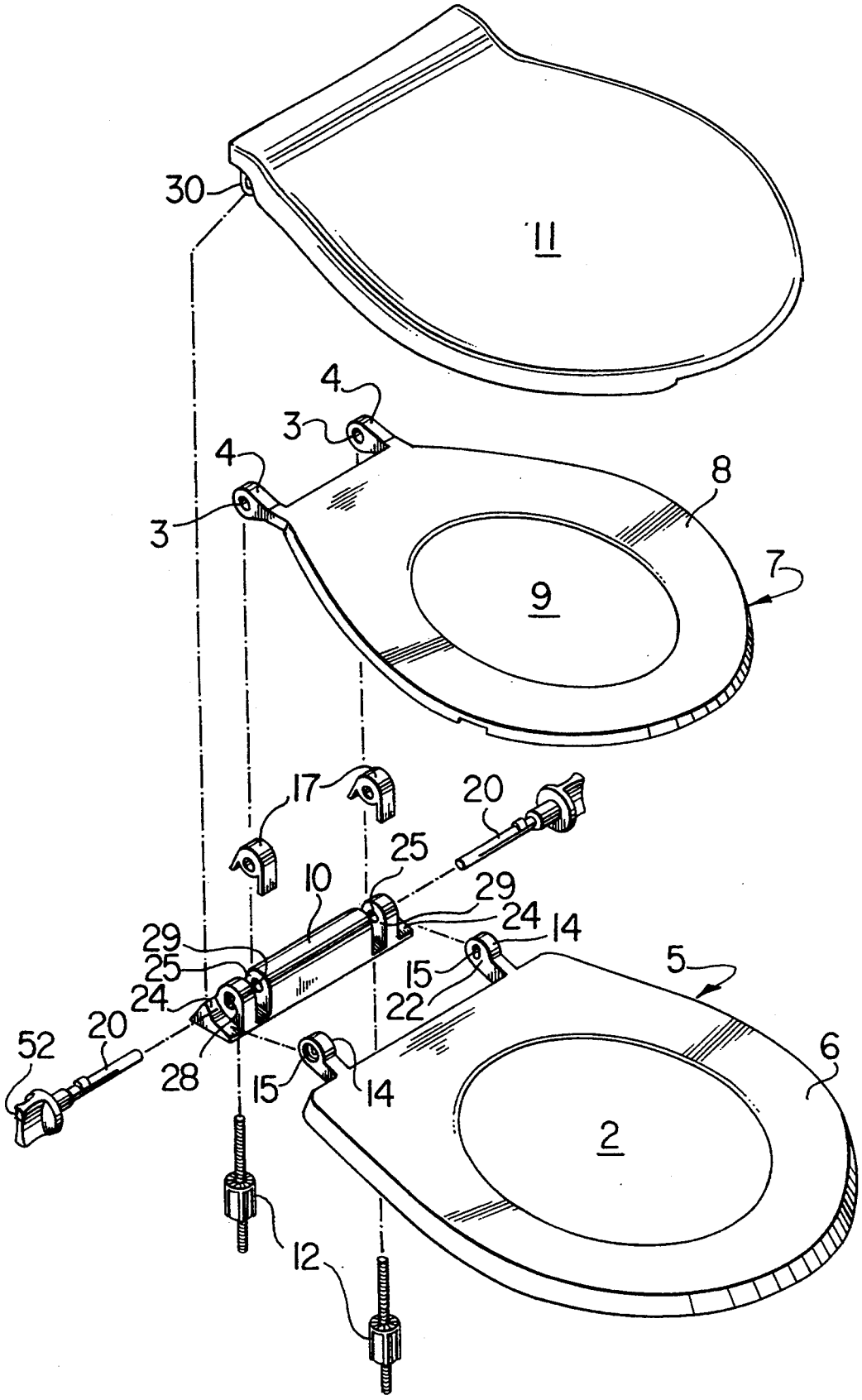
FIG. 3 is an exploded isometric view of the seat of FIG. 1.
Figure 5:
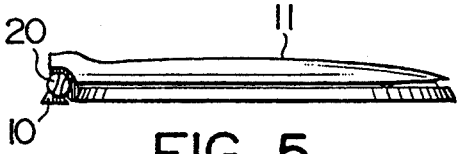
FIG. 5 is a side elevational view of the seat of FIG. 1.

With reference to FIGS. 1, 2 and 3, the present combination seat 1 generally comprises a first primary seat 5 for use by more mature children and adults, a second smaller auxiliary seat 7 for use by infants, a cover or lid 11 which envelopes seat 7 when in the closed position thereof as shown most clearly in FIG. 5 and a hinge block 10 to which both seats 5 and 7 and cover 11 are hingedly attached as will be described below in greater detail and which is used to attach seat 1 as a whole to the toilet bowl (not shown) by means of conventional threaded fasteners 12.

Auxiliary seat 7 incorporates a rim 8 surrounding an ovular opening 9 and a pair of spaced apart rearwardly extending lugs 4, each of the lugs having therein an axially aligned transversely extending aperture 3 formed therethrough. As will be described below, apertures 3 provide clearance for hinge pins 20 used to pivotally connect seats 5 and 7 and cover 11 to hinge block 10.

Primary seat 5 similarly includes a rim 6 surrounding an ovular opening 2 and a pair of spaced apart rearwardly extending lugs 14, each of the lugs having therein an axially aligned transversely extending aperture 15 formed therethrough for connection to hinge block 10 by means of hinge pins 20.

Obviously, the diameter of seat 5 exceeds that of seat 7 so that in its lowered position, seat 7 rests upon and is supported by the primary seat in something of a nested arrangement as seen most clearly from FIG. 2. This nesting lowers the combined profile of the two seats for a more streamlined enclosure of seat 7 by cover 11 so as to improve the seat's overall aesthetics, particularly in the closed position thereof.

For purposes of assembly, lugs 14 conformably fit into notches 24 at opposite ends of hinge block 10 and lugs 4 are similarly received into correspondingly shaped slots 25 in the hinge block inboard of the notches, wherein apertures 15 and 3 are axially aligned with apertures 28 and 29 formed in the hinge block itself.

Cover 11 includes a pair of spaced apart downwardly depending lugs 30 adjacent its rear edge, each lug including a transversely extending aperture 31 formed therethrough. When assembled to hinge block 10, lugs 30 closely bracket lugs 14 on seat 5 and apertures 31 line up axially with the apertures in the two seats and the hinge block. Hinge pins 20 are then simply inserted through the aligned apertures to pivotally secure the seats and to cover the hinge block. For cleaning and disassembly, pins 20 are extracted, and the seats and cover are then simply pulled apart.

When the infant seat is no longer required, it's removed in the manner described above and inserts 17 are used to fill slots 25 previously occupied by lugs 4.

To improve aesthetics, the outer visible surfaces of hinge block 10, lugs 4, 14 and 30 and inserts 17 (when in use) are conformably shaped to provide a smooth finished look to the assembled pieces along the hinge block as best seen from FIGS. 1 and 2.

Advantageously, hinge pin 20 should be lockable when inserted into the hinge block to prevent accidental or inadvertent retraction. This is accomplished in one embodiment constructed by the applicant as will now be described with particular reference to FIGS. 3, 6, 7 and 8.

Figure 6:
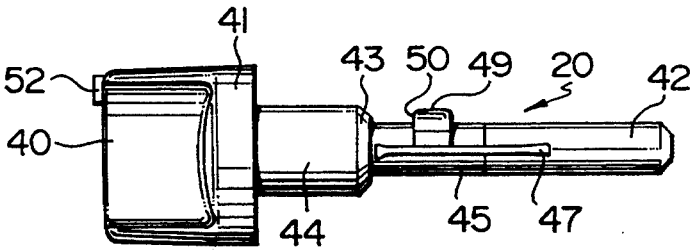
FIG. 6 is an elevational view of a hinge pin forming part of the seat of FIG. 1.

With reference to FIG. 6, each hinge pin 20 includes a flattened finger grip 40, a contiguous shoulder 41 and a shaft 42. Shaft 42 includes a first substantially enlarged diameter portion 44 immediately inboard of shoulder 41, a second slightly enlarged diameter portion 45, an elongated slot 47 formed through shaft 42 in a plane perpendicular to the plane of the finger grip, and a protrusion or cam 49 extending radially outwardly from portion 45 above slot 47 in the plane of the finger grip. The diameter of cam 49, when seen in plan, is the same as that of slightly enlarged portion 44.

The apertures 31 in lugs 30 on seat cover 11 are slightly larger in diameter than portion 44 of shaft 42 to permit a conformable but slightly loose or jiggly fit of the pin therethrough.

The length of enlarged shaft portion 44 exceeds the width of lug 30. Accordingly, the axially outer portion 16 of aperture 15 in lug 14 of the primary seat is similarly enlarged to receive the remaining inwardly projecting length of portion 44. The axially inner portion 18 of aperture 15 on the other hand is not only constricted in diameter, but the aperture 19 formed therethrough is obround in shape and is vertically offset as best seen from FIG. 8. Thus, aperture 19 is surrounded on its sides and a lower edge by a shoulder 21 which can abut against end surface 43 of first enlarged portion 44.

Figure 7:
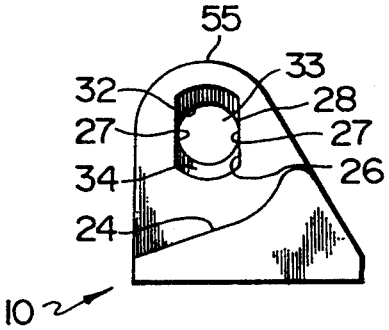
FIG. 7 is a side elevational view of a hinge block forming part of the seat of FIG. 1.
Figure 8:
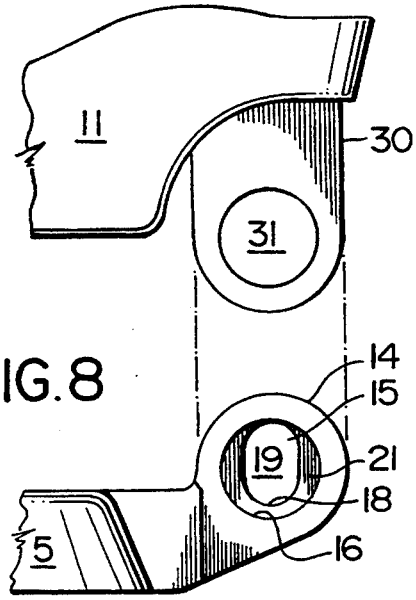
FIG. 8 is a side elevational view of a portion of a seat forming part of the seat of FIG. 1.

Proceeding inwardly, and as best seen from FIG. 7, the aperture 28 in the lug 55 on hinge block 10 separating notch 24 from slot 25 also includes an axially outer portion 26 that is obround in shape, and an axially inner portion 32 featuring a simple circular aperture 33 centered in relation to aperture 26 by a surrounding shoulder 34.

When the seats, lid and hinge block are assembled together, all of the various apertures described above line up although they need not line up exactly. Insertion of pin 20 will generally bring everything into closer alignment. The pin is inserted with the finger grip aligned in the vertical plane so that cam 49 is also aligned in the vertical plane as shown in FIG. 3. The widths of obround apertures 19 and 26 are slightly greater than the width of cam 49 so that with the cam in this vertical position, pin 20 can be freely inserted and removed.

The inward extent of the pin's travel is limited by the abutment of cam 49 against shoulder 34. If the pin is now rotated in either the clockwise or counter-clockwise directions, cam 49 will frictionally bear against a respective one of vertical sides 27 of aperture 26. If shaft 42 were solid, this contact would prevent such rotation but the force of the cam against one of surfaces 27 narrows slot 47 to reduce the diameter of shaft 42 and this allows the pin to turn relatively easily. By making obround aperture 19 in lug 14 slightly narrower than aperture 26, the lateral surface 50 of cam 49 will abut against the opposing surface 22 of shoulder 21 after even a small amount of rotation of the pin to prevent its withdrawal. It is intended however that the pin will be rotated a full 180° so that cam 49 will then be extending downwardly. In this position the cam is caught in a well defined by the lower portion of aperture 26 between the lower edges of opposed shoulders 21 and 34.

Rotating the pin another 180° brings cam 49 back into its vertical position from which it can be easily retracted from the seat assembly. A small arrow or marking 52 on the finger grip provides a visual indication of the cam's position. Thus, with the arrow at the top of the finger grip, the pin is seen to be removable and when the arrow is at the bottom of the grip, the pin can be seen to be in its locked position.

Figure 4:
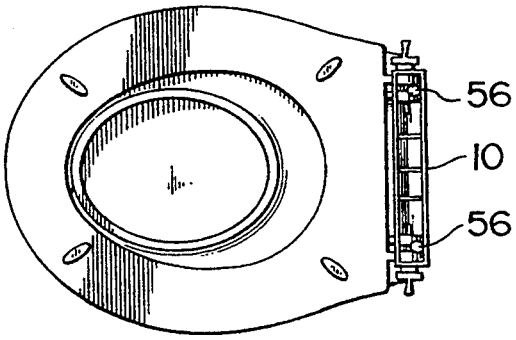
FIG. 4 is a bottom plan view of the seat of FIG. 1.

As best seen from FIG. 4, the bottom of hinge block 10 is provided with a pair of spaced apart threaded bushings 56 to engage threaded fasteners 12 used to connect the hinge block to the toilet bowl (not shown) in the conventional way.

Figure 9:
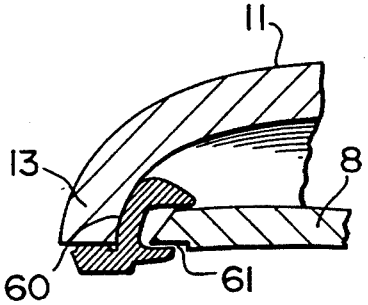
FIG. 9 is a side elevational partially sectional view of a clip forming part of the seat of FIG. 1.

As mentioned above, a major inconvenience arises if each time the primary seat is to be used, the cover and the infant seat must be lifted separately. It's preferable in this regard that a single motion lift both pieces. This is accomplished in the present seat by the provision of at least one but preferably two resilient clips 60 at spaced apart locations on the inner lip 13 of cover 11 as seen most clearly in FIGS. 1 and 2. The profile of a suitable clip is shown with reference to FIG. 9.

Clips 60 are adapted to grip and hold the infant seat at correspondingly located notches 61 formed in the outer edge of rim 8.

Clips 60 advantageously are sufficiently pliable that by simply allowing cover 11 to fall against seat 7 under gravity the clips will engage notches 61 so that when the cover is next lifted, seat 7 will be entrained. If the cover is not engaged in this way, a slight downward push on the cover as it overlies the infant seat will result in a noticeable click that signals engagement.

Whether the infant seat is in place or removed, the lowermost surface of clip 60 will abut against the upper surface of seat 5 when the cover is closed to provide an aesthetically pleasing separation between the cover and seat 5. This spacing will not be changed perceptibly after the infant seat is eventually removed when no longer needed.

I claim:

1. A toilet seat assembly comprising:

a first seat;

a second smaller seat supported by said first seat when in a lowered position thereof;

a cover for said first and second seats;

a hinge block; and retractable pin means for hingedly connecting said first and second seats and said cover to said hinge block; said pin means being rotatable relative to said hinge block between a first position, wherein said pin means are freely insertable and retractable into and from said hinge block, and a second position, wherein said pin means are non-retractable therefrom; said pin means including a grip portion, a shaft extending axially from said grip portion, a cam extending radially from said shaft and aligned transversely thereto for engaging an opposing surface on one of said first and second seats when said pin means are rotated into said second position thereof to prevent retraction thereof, and means permitting said cam means to deflect inwardly relative to said shaft to facilitate rotation of said pin means between said first and second positions thereof.

2. The assembly of claim 1 wherein said means permitting said cam means to deflect inwardly comprises a slot formed transversely through said shaft beneath said cam in opposed relationship thereto.

3. The assembly of claim 2 wherein each of said first and second seats includes a pair of spaced apart rearwardly extending lug means thereon for engaging said hinge block, each of said lug means including an aperture extending transversely therethrough for receiving said pin means therein.

4. The assembly of claim 3 wherein said hinge block includes a notch formed at opposite ends thereof to receive a respective one of said lug means on said first seat, a slot formed inwardly of each of said notches to receive a respective one of said lug means on said second seat, and a pillar separating each of said notches from said slots, each said pillar having an aperture formed transversely therethrough to receive said pin means therein.

5. The assembly of claim 4 wherein said aperture in each of said pillars comprises a first obround axially outer portion having opposed straight sides defining inner and outer surfaces extending partially through said pillar and a circular portion centered in relation to said obround outer portion and extending the remaining way through said pillar, the inner surface of said obround outer portion defining a shoulder about said circular portion, the distance between opposed straight sides of said obround outer portion only slightly exceeding the width of said cam on said pin means.

6. The assembly of claim 5 wherein contact between said cam and said shoulder limits the extent of insertion of said pin means such that said cam, with said pin means fully inserted and in said first position thereof, is received in alignment in said obround outer portion, said cam being deflected inwardly relative to said shaft as said cam is moved into contact with a respective one of said straight sides of said obround outer portion as said pin means are rotated into said second position thereof.

7. The assembly of claim 6 wherein said aperture in each of said lugs in said first seat comprise a first obround axially inner portion, the distance between opposed straight sides of said first obround inner portion only slightly exceeding said width of said cam to permit insertion and retraction therethrough of said pin means when in said first position thereof.

8. The assembly of claim 7 wherein rotation of said pin means into said second position thereof prevents retraction of said pin means due to abutment of said cam with said opposing surface, said opposing surface surrounding said first obround inner portion of said aperture in a respective one of said lugs of said first seat.

9. The assembly of claim 8 wherein said first obround inner portion of said aperture in each lug of said first seat is vertically offset relative to said obround outer portion of said aperture in respective ones of said pillars to prevent retraction of said pin means when rotated 180 from said first portion thereof.

10. The assembly of claim 9 wherein said aperture in each lug of said first seat comprises an axially outer circular portion.

11. The assembly of claim 10 wherein said shaft of said pin means includes an enlarged diameter portion between said grip portion and said cam, said enlarged diameter portion being at least partially receivable into said axially outer circular portion of said aperture in respective ones of said lugs on said first seat.

12. The assembly of claim 11 wherein said first position of said pin means represents substantially zero degrees of rotation thereof.

13. The assembly of claim 12 wherein said second position of said pin means represents substantially any position in excess of zero degrees of rotation thereof.

14. The assembly of claim 1 further including resilient clip means disposed on said cover, said clip means being adapted to engage and thereby hold said second seat for mutual rotation thereof about said pin means.

15. The assembly of claim 14 wherein said second seat includes notches formed in the periphery thereof in registry with said resilient clip means to facilitate the connection between said clip means and said second seat.

16. The assembly of claim 15 wherein said clip means comprise at least two spaced apart resilient clips disposed on a lower surface of said cover.

* * * * *